US010058176B2

(12) United States Patent
Rehage

(10) Patent No.: US 10,058,176 B2
(45) Date of Patent: Aug. 28, 2018

(54) SLIDING ASSEMBLY

(71) Applicant: Paul Hettich GmbH & Co. KG, Kirchlengern (DE)

(72) Inventor: Daniel Rehage, Chemnitz (DE)

(73) Assignee: Paul Hettich GmbH & Co. KG, Kirchlengern (DE)

( * ) Notice: Subject to any disclaimer, the term of this patent is extended or adjusted under 35 U.S.C. 154(b) by 0 days.

(21) Appl. No.: 15/316,008

(22) PCT Filed: Jun. 2, 2015

(86) PCT No.: PCT/EP2015/062268
§ 371 (c)(1),
(2) Date: Dec. 2, 2016

(87) PCT Pub. No.: WO2015/185557
PCT Pub. Date: Dec. 10, 2015

(65) Prior Publication Data

US 2017/0086584 A1 Mar. 30, 2017

(30) Foreign Application Priority Data

Jun. 2, 2014 (DE) ..... 10 2014 107 692

(51) Int. Cl.
*A47B 96/04* (2006.01)
*A47B 88/75* (2017.01)
(Continued)

(52) U.S. Cl.
CPC ..... *A47B 88/75* (2017.01); *A47B 88/423* (2017.01); *A47B 88/447* (2017.01); *A47B 88/45* (2017.01);
(Continued)

(58) Field of Classification Search
CPC ..... A47B 88/75; A47B 88/423; A47B 88/473; A47B 88/467; A47B 88/70; A47B 88/447;
(Continued)

(56) References Cited

U.S. PATENT DOCUMENTS 2,868,608 A * 1/1959 Gunn ..... A47B 88/493 312/334.13
3,298,768 A * 1/1967 Vogt ..... F16C 29/045 312/334.12
(Continued)

FOREIGN PATENT DOCUMENTS

DE 38 34 688 A1 11/1989
DE 41 21 070 A1 1/1993
DE 10 2011 050 523 A1 11/2012

OTHER PUBLICATIONS

German Search Report issued in counterpart German Application No. 10 2014 107 692.3 dated Oct. 2, 2015 with partial English translation (12 pages).
International Search Report (PCT/ISA/210) issued in PCT Application No. PCT/EP2015/062268 dated Aug. 18, 2015 with English translation (five pages).
(Continued)

*Primary Examiner* — Hanh V Tran
(74) *Attorney, Agent, or Firm* — Crowell & Moring LLP

(57) ABSTRACT

A sliding assembly includes two pull-out guides which can be secured to opposite side walls and each of which includes a stationary guide rail, a middle rail movably mounted on the guide rail, and a running rail movably mounted on the middle rail. A first slidable element is retained on the two running rails of the two pull-out guides, and a second slidable element is retained on the two middle rails of the two pull-out guides. By moving one slidable element, the other slidable element can also be moved.

16 Claims, 10 Drawing Sheets

(51) Int. Cl.

| | |
|---|---|
| ***F25D 25/02*** | (2006.01) |
| ***A47B 88/70*** | (2017.01) |
| ***A47B 88/423*** | (2017.01) |
| ***A47B 88/473*** | (2017.01) |
| ***A47B 88/467*** | (2017.01) |
| ***A47B 88/447*** | (2017.01) |
| ***A47B 88/493*** | (2017.01) |
| ***A47B 88/45*** | (2017.01) |
| ***A47B 95/02*** | (2006.01) |
| *F25D 23/02* | (2006.01) |
| *F25D 23/06* | (2006.01) |

(52) U.S. Cl.

CPC ..... *A47B 88/467* (2017.01); *A47B 88/473* (2017.01); *A47B 88/493* (2017.01); *A47B 88/70* (2017.01); *A47B 95/02* (2013.01); *F25D 25/025* (2013.01); *A47B 2088/76* (2017.01); *A47B 2095/024* (2013.01); *A47B 2210/007* (2013.01); *A47B 2210/0008* (2013.01); *A47B 2210/0037* (2013.01); *A47B 2210/0072* (2013.01); *A47B 2210/175* (2013.01); *F25D 23/021* (2013.01); *F25D 23/067* (2013.01)

(58) Field of Classification Search

CPC ..... A47B 88/493; A47B 88/45; A47B 95/02; A47B 2088/76; A47B 2095/024; A47B 2210/0008; A47B 2210/0037; A47B 2210/007; A47B 2210/0072; A47B 2210/175; F25D 25/025; F25D 23/021; F25D 23/067

See application file for complete search history.

(56) References Cited

U.S. PATENT DOCUMENTS

| | | | | |
|---|---|---|---|---|
| 3,904,254 | A * | 9/1975 | Hagen | F16C 29/04 312/334.47 |
| 4,324,439 | A * | 4/1982 | Hagen | A47B 88/493 312/331 |
| 4,470,642 | A * | 9/1984 | Gasperin | A47B 88/493 312/331 |
| 9,389,014 | B2 * | 7/2016 | Rehage | F25D 25/025 |
| 9,675,174 | B2 * | 6/2017 | Jahrling | A47B 88/483 |
| 2003/0173882 | A1 * | 9/2003 | Koons | F25D 23/021 312/404 |
| 2006/0266070 | A1 | 11/2006 | Ertz et al. | |
| 2007/0018548 | A1 * | 1/2007 | Ertz | F25D 25/025 312/402 |
| 2011/0210655 | A1 * | 9/2011 | Brown | F25D 25/025 312/334.8 |
| 2012/0217858 | A1 * | 8/2012 | Lai | A47B 17/00 312/334.5 |
| 2013/0169132 | A1 * | 7/2013 | Johnson | A47B 88/70 312/298 |
| 2013/0264928 | A1 * | 10/2013 | Hong | F25D 25/025 312/404 |
| 2014/0239789 | A1 * | 8/2014 | Rehage | F25D 25/025 312/402 |
| 2017/0051967 | A1 * | 2/2017 | Tierney | F25D 25/022 |

OTHER PUBLICATIONS

German-language Written Opinion (PCT/ISA/237) issued in PCT Application No. PCT/EP2015/062268 dated Aug. 18, 2015 (five pages).

* cited by examiner

SLIDING ASSEMBLY

FIELD OF THE INVENTION

The present invention relates to a sliding assembly, comprising two pull-out guides which can be fixed to opposite side walls and which each comprise a stationary guide rail, a middle rail movably mounted on the guide rail, and a running rail movably mounted on the middle rail, wherein a first sliding element is retained on the two running rails of the two pull-out guides. The present invention further relates to a domestic appliance and a furniture item having such a sliding assembly.

BACKGROUND AND SUMMARY OF THE INVENTION

DE 10 2011 050 523 shows a pull-out system, in which a first sliding element is displaceably mounted on a pull-out guide, which is connected via a gear to a second pull-out guide on which a second sliding element is retained. The second sliding element can thus also be moved when displacing the first sliding element. The use of two pull-out guides and a gear is comparatively complex. Especially in the case of domestic appliances there is also a limited amount of available space, which poses problems when installing a pull-out system with two pull-out guides and a gear.

It is therefore the object of the present invention to provide a sliding assembly which is arranged in a compact manner and allows an effective movement of two sliding elements.

A sliding assembly in accordance with embodiments of the invention is provided for achieving this object.

According to the invention, two pull-out guides are provided which can be fixed to opposite side walls of a furniture body or domestic appliance, wherein a first sliding element is retained on the two running rails of the two pull-out guides and a second sliding element is retained on the two middle rails of the two pull-out guides. A displacement of two sliding elements can thus be achieved with only two pull-out guides. As a result of the relative movement of the running rail to the middle rail, the sliding elements are moved at different velocities and with a different path of displacement.

A synchronizer is preferably provided at least on one pull-out guide in order to synchronise the movement of the running rail in relation to the middle rail. The running rails are preferably displaced with approximately twice the speed in relation to the middle rails and also cover twice the distance. A respective cable pull can be provided for synchronisation on at least one pull-out guide, preferably on both pull-out guides. The cable pull can be guided over deflection pulleys which are fixed to the middle rail, so that it is ensured by way of fixing the cable pull to the running rail and the guide rail that the movement of the running rail is synchronised in relation to the middle rail, i.e. slippage between the running rail and the middle rail is prevented. Other types of synchronizers such as toothed gears or chain gears can also be used.

According to a further embodiment, the first sliding element can reversibly be fixed to retainers on the running rail and/or the second sliding element to retainers of the middle rail. They especially can be hooked into said retainers or placed thereon. The sliding elements can thus be mounted or dismounted in a simple way. The first sliding element is preferably arranged beneath the second sliding element and can be hooked into retainers, especially angular retainers. The upper second sliding element can be placed on retainers, e.g. on connecting rods, which are provided between the two middle rails. The connecting rods can additionally synchronise the right and left pull-out guide with respect to their movement. The sliding elements can also be formed in such a way that the first sliding element is placed on the retainer and the second sliding element is hooked into the retainer.

The retainers can alternatively be formed as a circumferential frame, e.g. for waste containers, or as a plate in order to accommodate containers irrespective of their outer contour. The plate could advantageously comprise adjustable locking elements which can flexibly be adjusted to the respective contour of the container.

An actuating element is preferably provided on the front side of the bottom first sliding element, which protrudes upwardly. The actuating element can be fixed to opposite sides on the running rail and thus controls the movement of the bottom sliding element without requiring the user to completely bend down towards the bottom sliding element. The actuating element can protrude at least partly beyond the front side of the upper second sliding element, so that the actuating element can be gripped easily and can be inserted for the movement of the two sliding elements. The actuating element can be formed as a U-shaped bracket whose upper connecting element forms a handle which is arranged above the second sliding element.

For simple handling, the sliding elements can be formed as drawers, e.g. as drawers made of plastic, which are inserted into the pull-out guides and can be removed therefrom.

The bottom first sliding element is preferably formed in a shorter way in the longitudinal direction of the pull-out guide than the upper second sliding element, especially by at least 20%, or by at least 40% by way of example. This also ensures access to the rear region of the bottom sliding element when the sliding element is not completely arranged in the extended position, which simplifies handling. Furthermore, the space on the rear side of the bottom sliding element can be used in a different way as a result of the shortened construction.

The two pull-out guides are preferably mounted in such a way that the displaceable running rail is respectively arranged beneath the stationary guide rail. Angular retainers for retaining a sliding element can then be fixed to the running rail.

The invention is preferably used in domestic appliances, especially freezers, wherein the sliding assembly displaceably mounts the two bottom drawers of a refrigeration compartment. Other applications such as for furniture items or other domestic appliances are possible.

It is also possible to arrange the first sliding element above the second sliding element, e.g. in cupboards beneath the kitchen sink or washbasin. In this case, the running rail is arranged above the guide rail.

The invention will be explained below in closer detail by reference to the enclosed drawings, wherein:

DETAILED DESCRIPTION OF THE PREFERRED EMBODIMENTS

Figure 1:
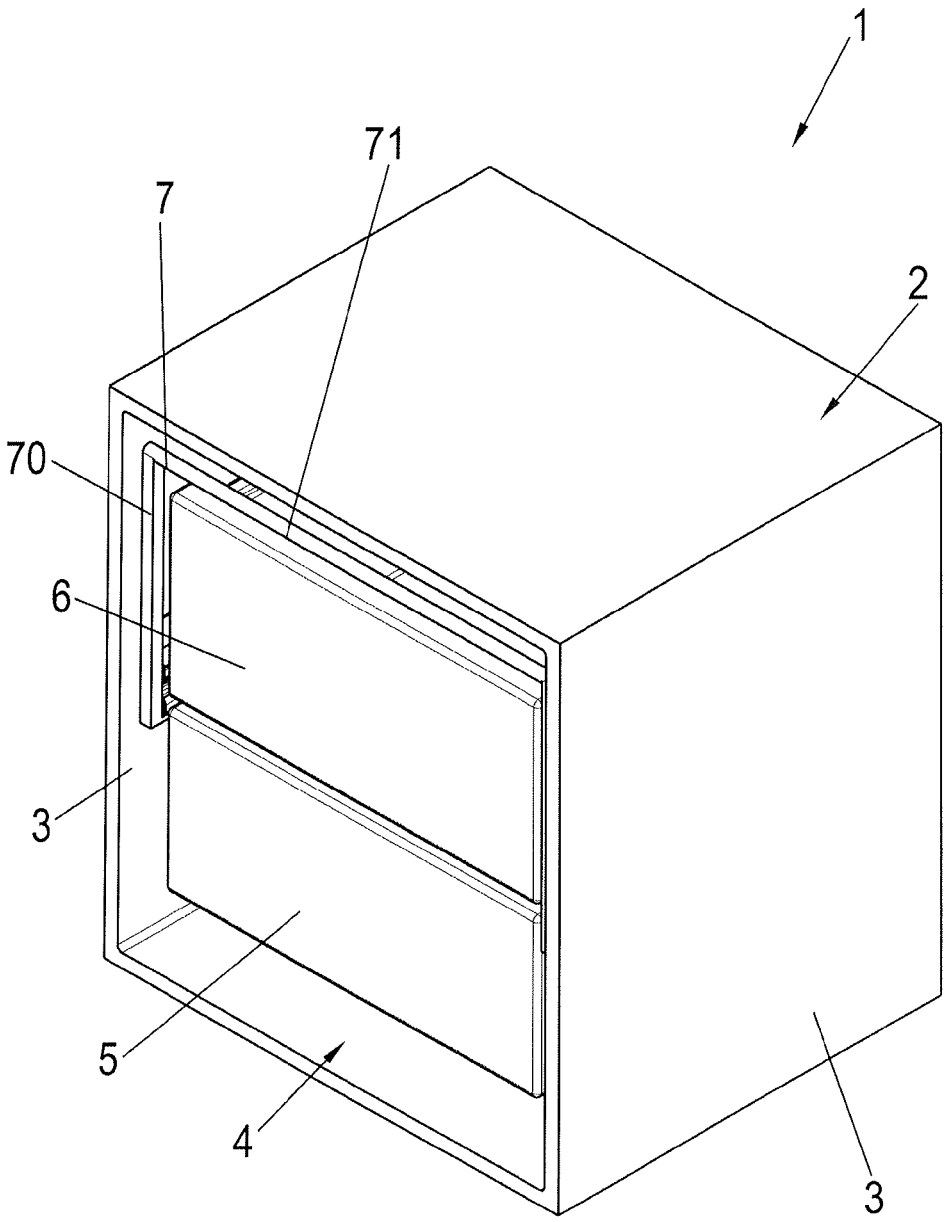
FIG. 1 shows a perspective view of a sliding assembly in the installed state in a closed position.

A piece of furniture or a domestic appliance 1 comprises a furniture body 2 such as a body of a refrigeration compartment of a refrigerator or a refrigerator-freezer combination, comprising two side walls 3 on which a sliding assembly 4 is mounted. The sliding assembly 4 can be mounted directly on the side walls 3 or via further fastening elements.

The sliding assembly 4 comprises a bottom first sliding element 5 and an upper second sliding element 6, which are each formed as drawers and are used for storing items such as food. An actuating element 7 is provided on the bottom sliding element 5, which actuating element is formed as a U-shaped bracket and comprises two vertical legs 70 and a connecting element 71. In the closed position, the connecting element 71 is arranged above a front side of the upper sliding element 6. The connecting element 71 can thus be gripped easily in order to move the sliding assembly from a closed position to an open position.

Figure 2:
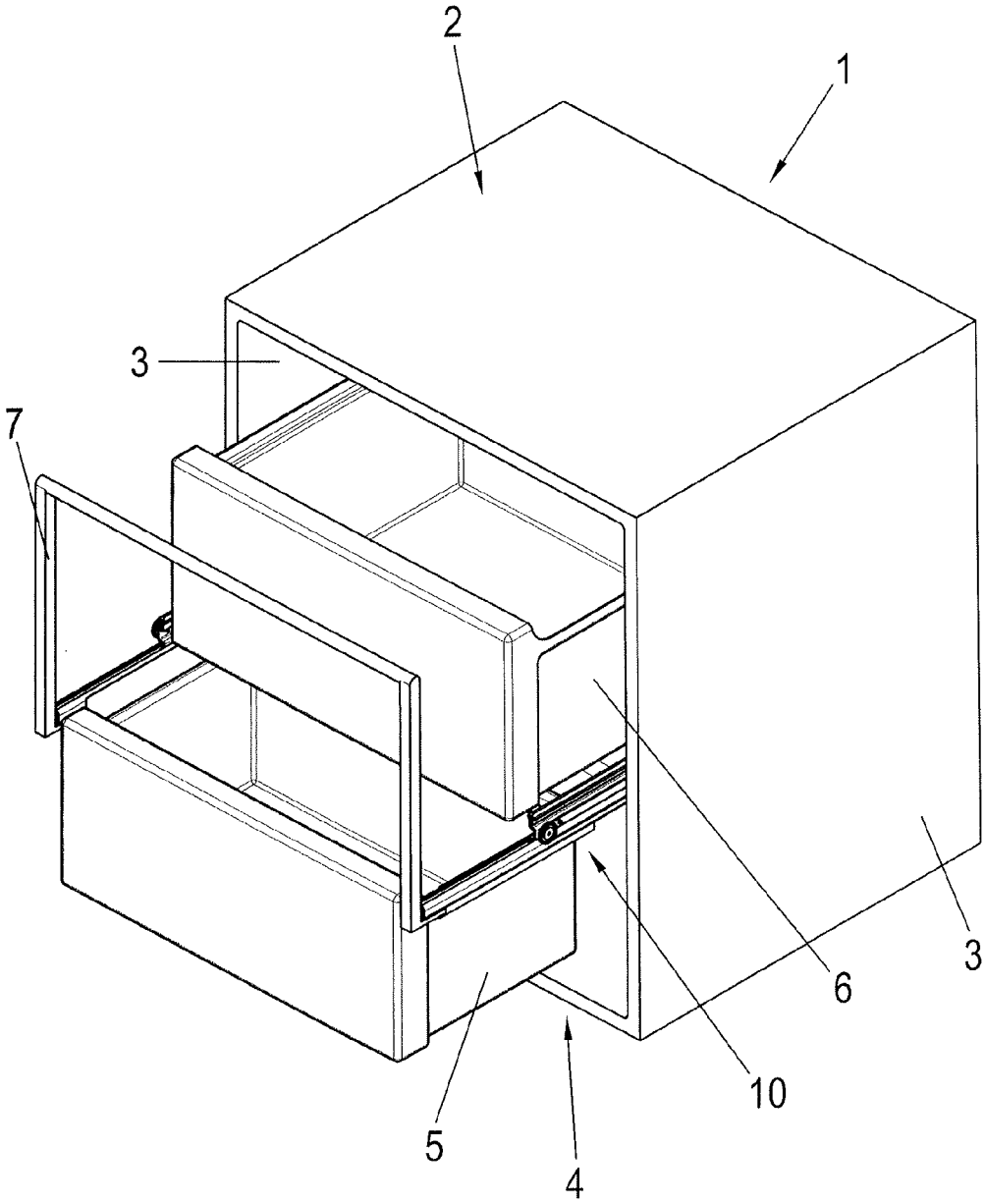
FIG. 2 shows a perspective view of the sliding assembly of FIG. 1 in a partly extended position.

FIG. 2 shows the sliding assembly 4 in a partly open position outside of the furniture body 2. Pull-out guides 10 are provided for this purpose in the sliding assembly 4 on opposite sides, by way of which the sliding elements 5 and 6 can be displaced.

Figure 3:
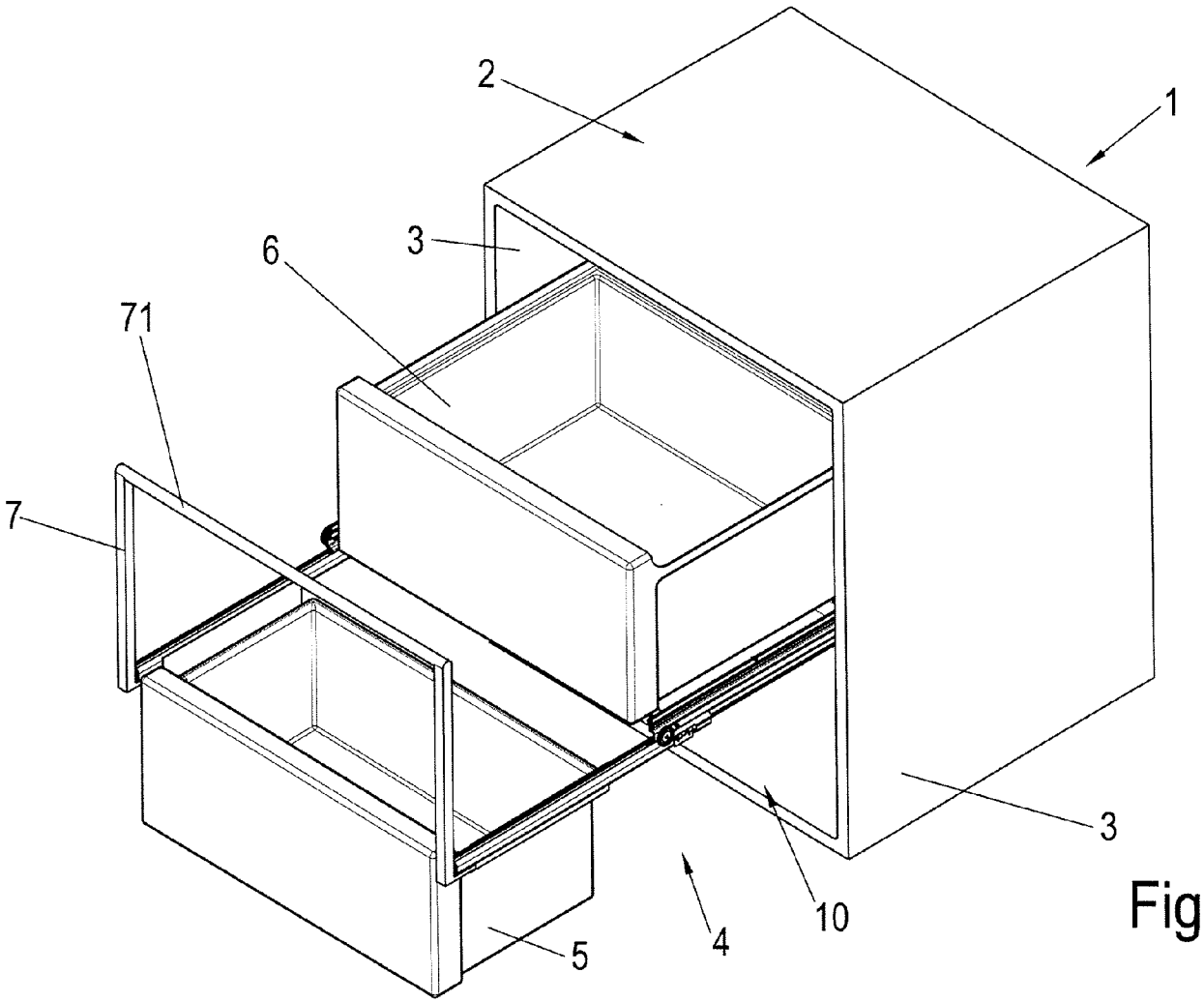
FIG. 3 shows a perspective view of the sliding assembly of FIG. 1 in an extended position.

FIG. 3 shows the sliding assembly in a maximum extended position. The bottom first sliding element 5 is now situated completely in front of the upper second sliding element 6 so that access is ensured from above to the interior space both of the bottom first sliding element 5 and also the upper second sliding element 6.

FIGS. 4A to 4D show the pull-out guides 10 of the sliding assembly 4 in the closed position in detail. Each pull-out guide 10 comprises a stationary guide rail 11, a middle rail 12 which is movably mounted on the guide rail 11, and a running rail 13 which is movably mounted on the middle rail 12. Rolling bodies or rollers can be provided for movably mounting the middle rail 12 and the running rail 13.

The guide rail 11 is fixed via mounting brackets 14 to the side walls 3 or components connected to the side walls 3. In order to ensure that the first sliding element is movable with the running rail 13, retainers 15, preferably angular retainers 15, are provided on each running rail 13, so that the first sliding element 5 can be hooked into the retainers 15. The middle rails 12 are connected to each other above the retainer 15 via two retainers in the form of connecting rods 16, and the second sliding element 6 can be placed on the two connecting rods 16 and can be fixed there. The connecting rods 16 produce a synchronisation of the movement of the left pull-out guide 10 with the right pull-out guide 10.

In order to obtain a synchronised movement of the running rail 13 and the middle rail 12 in which the running rail 13 is moved with approximately twice the speed in relation to the middle rail 12, a synchronizer is provided, which is formed in the embodiment as a tensioner and is explicitly formed as a cable pull 23. The cable pull 23 is circumferentially guided on the deflection pulleys 21 and 22. The deflection pulleys 21 and 22 are rotatably mounted on the middle rail 12. The cable pull 23 is formed in an interrupted way, wherein the one ends of the cable pull 23 are held on a first connecting element 24 on the running rail 13 and the other ends on a second connecting element 30 which is fixed to the guide rail 10.

Figure 4A:
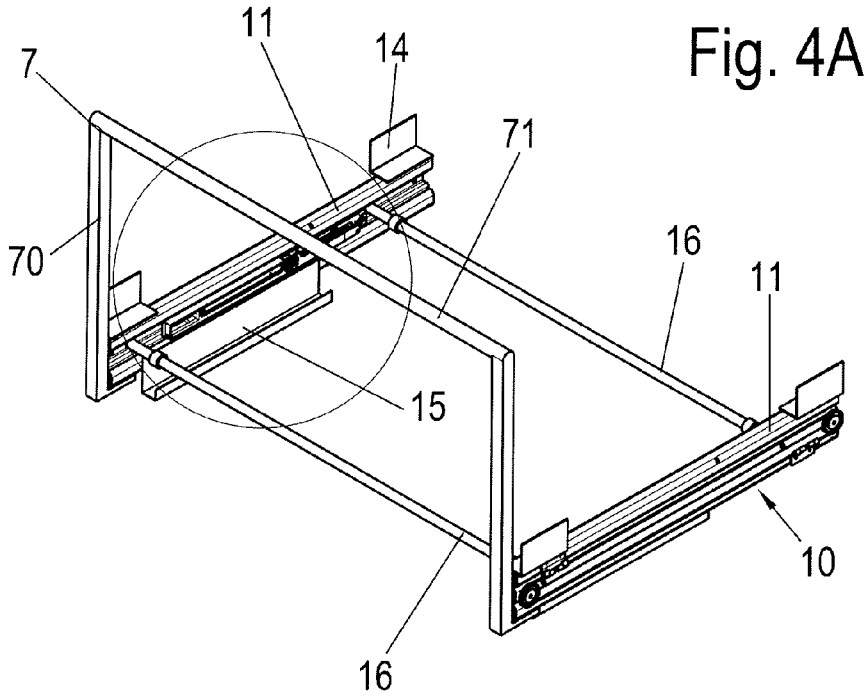
FIGS. 4A to 4D show several views of the pull-out guides of the sliding assembly without sliding elements in the closing position.
Figure 4B:
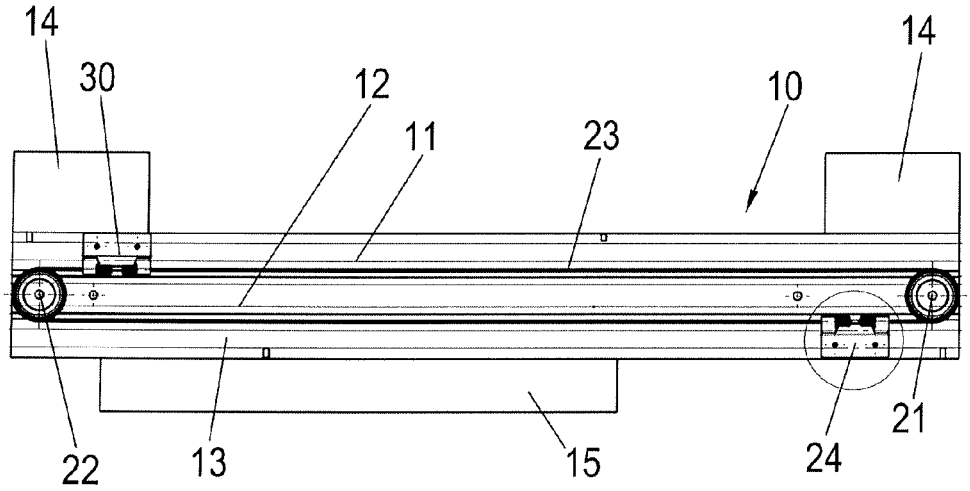
Figure 4C:
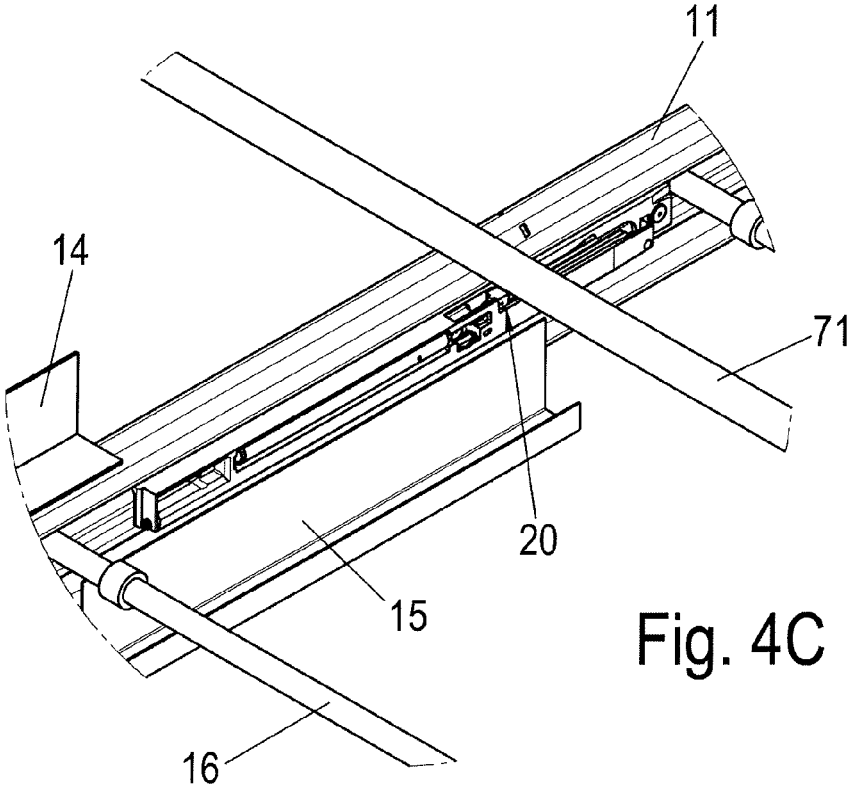

FIG. 4C shows that the pull-out guide comprises a self-retracting apparatus 20 in the region of the middle rail 12, which self-retracting apparatus pretensions the sliding assembly 4 to a closed position, at least in a region shortly before the closing position. The self-retracting apparatus 20 can further comprise a damper in order to decelerate the closing movement of the sliding assembly 4.

Figure 4D:
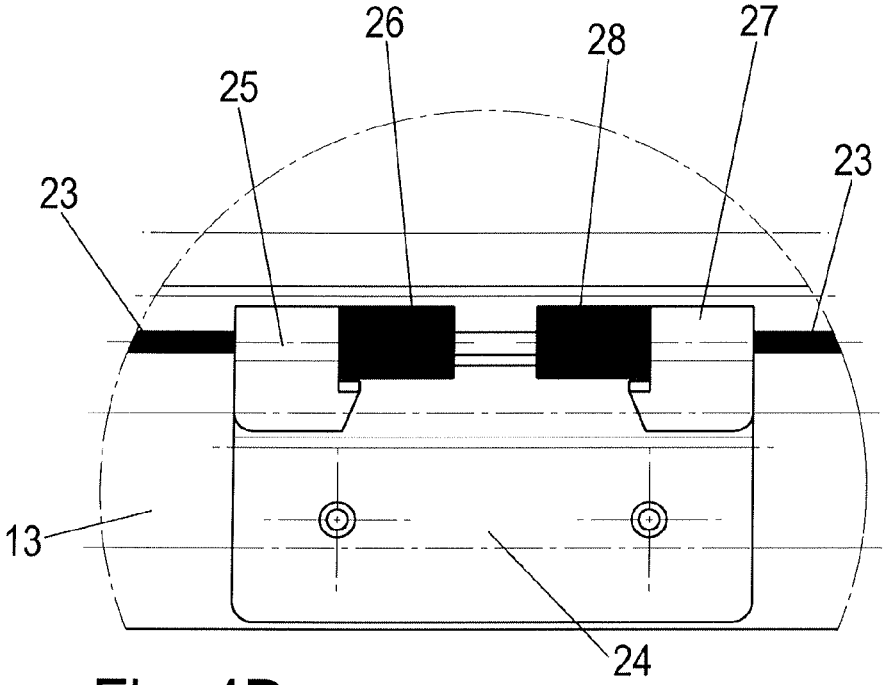

FIG. 4D shows the first connection element 24 in order to fix a first end 26 of the cable pull 23 to an angled section 25. A second angled section 27 is provided on the connection element 24 adjacent to the angled section 25, on which a second end 28 of the cable pull 23 is retained. Two ends of the cable pull 23 are fixed in a similar manner on the second connection element 30, so that during a movement of the running rail 13 in the pull-out direction the cable pull 23 is moved over the deflection pulleys 21 and 22, and it is thus ensured that the middle rail 12 is moved with half the velocity as the running rail 13.

Figure 5A:
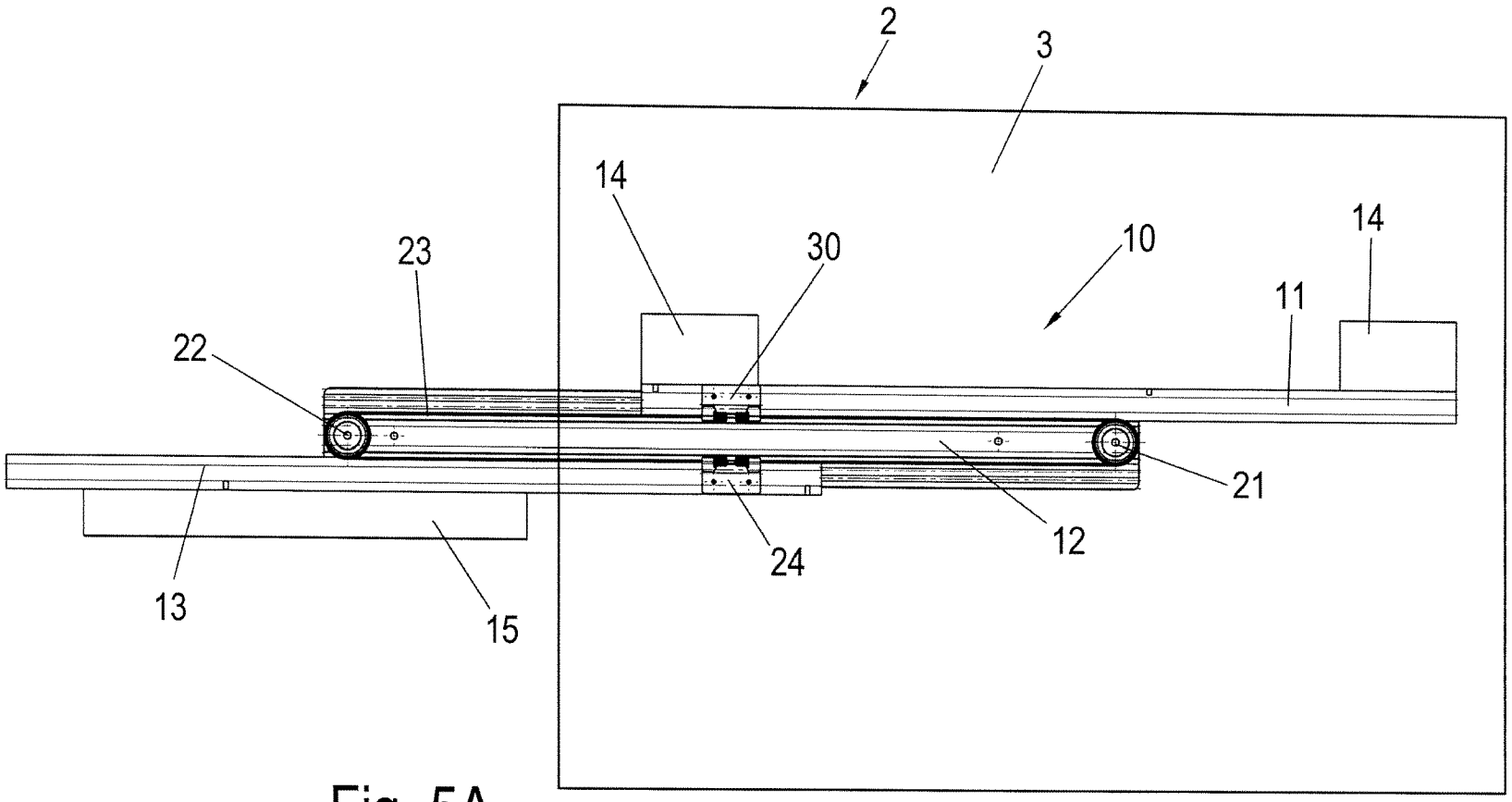
FIGS. 5A to 5C show several views of the pull-out guides of the sliding assembly in a middle extended position.
Figures 5B, 5C:
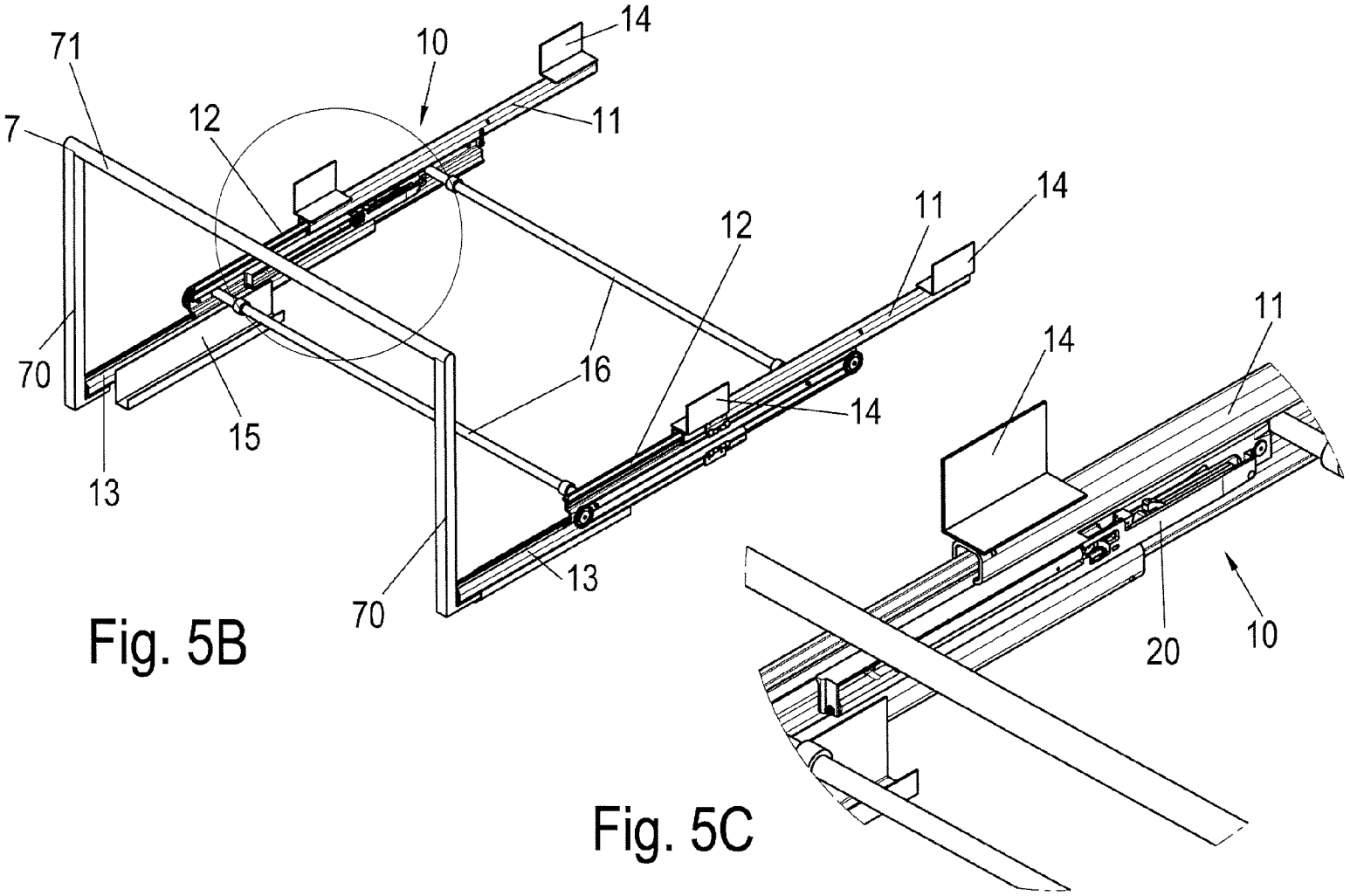

The pull-out guides are in a middle pull-out position in FIGS. 5A to 5C. It can be recognized that the guide rail 11 remains in a stationary manner in the furniture body 2, while the middle rail 12 and the running rail 13 are moved from the furniture body 2. The retainer 15 is arranged beneath the connecting rods 16, while the upper second sliding element 6 is placed on the connecting rods 16 so that the sliding elements 5 and 6 can be moved relative to each other.

Figure 6A:
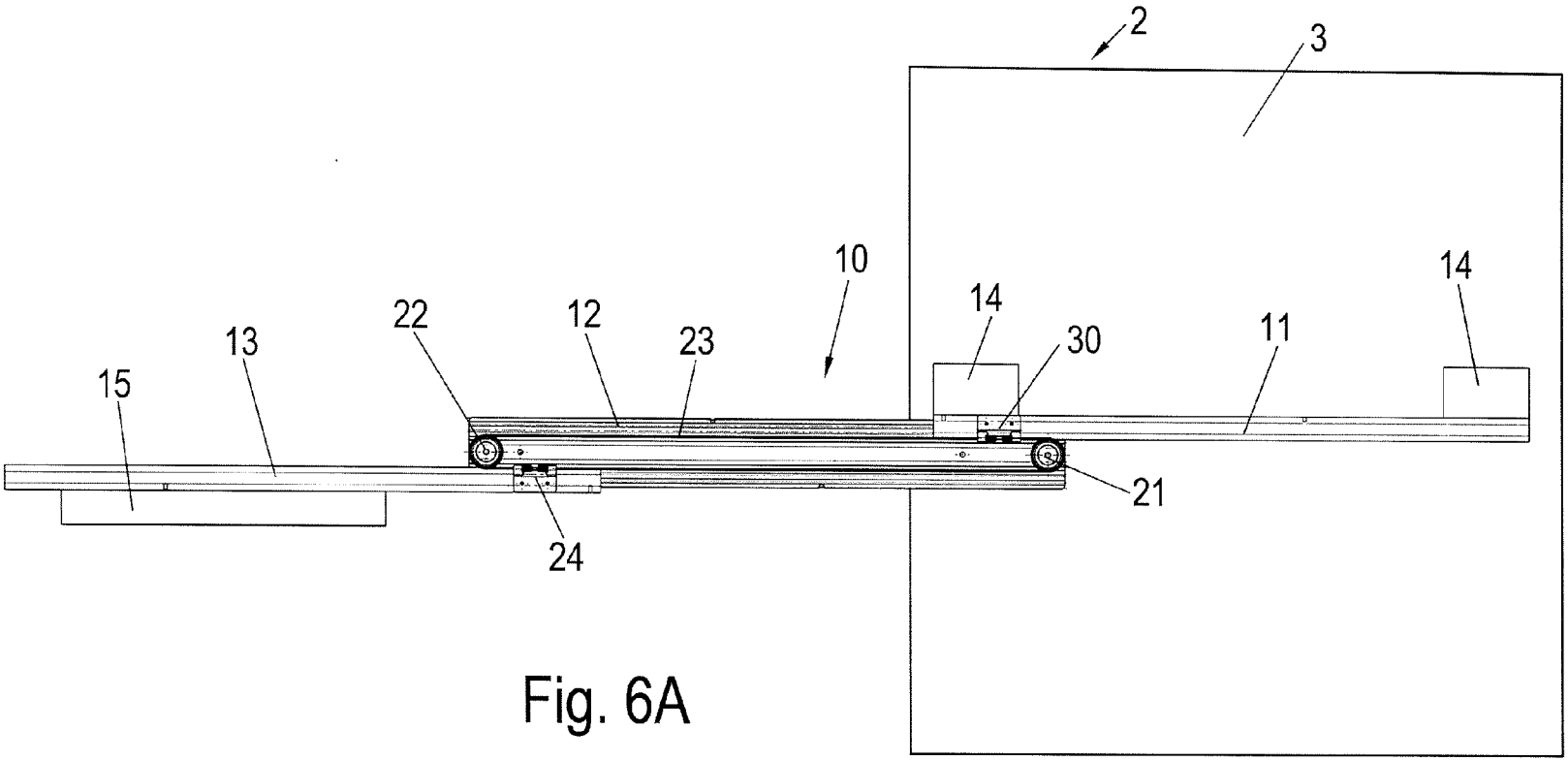
FIGS. 6A to 6C show several views of the pull-out guides of the sliding assembly in a maximum extended position.
Figures 6B, 6C:
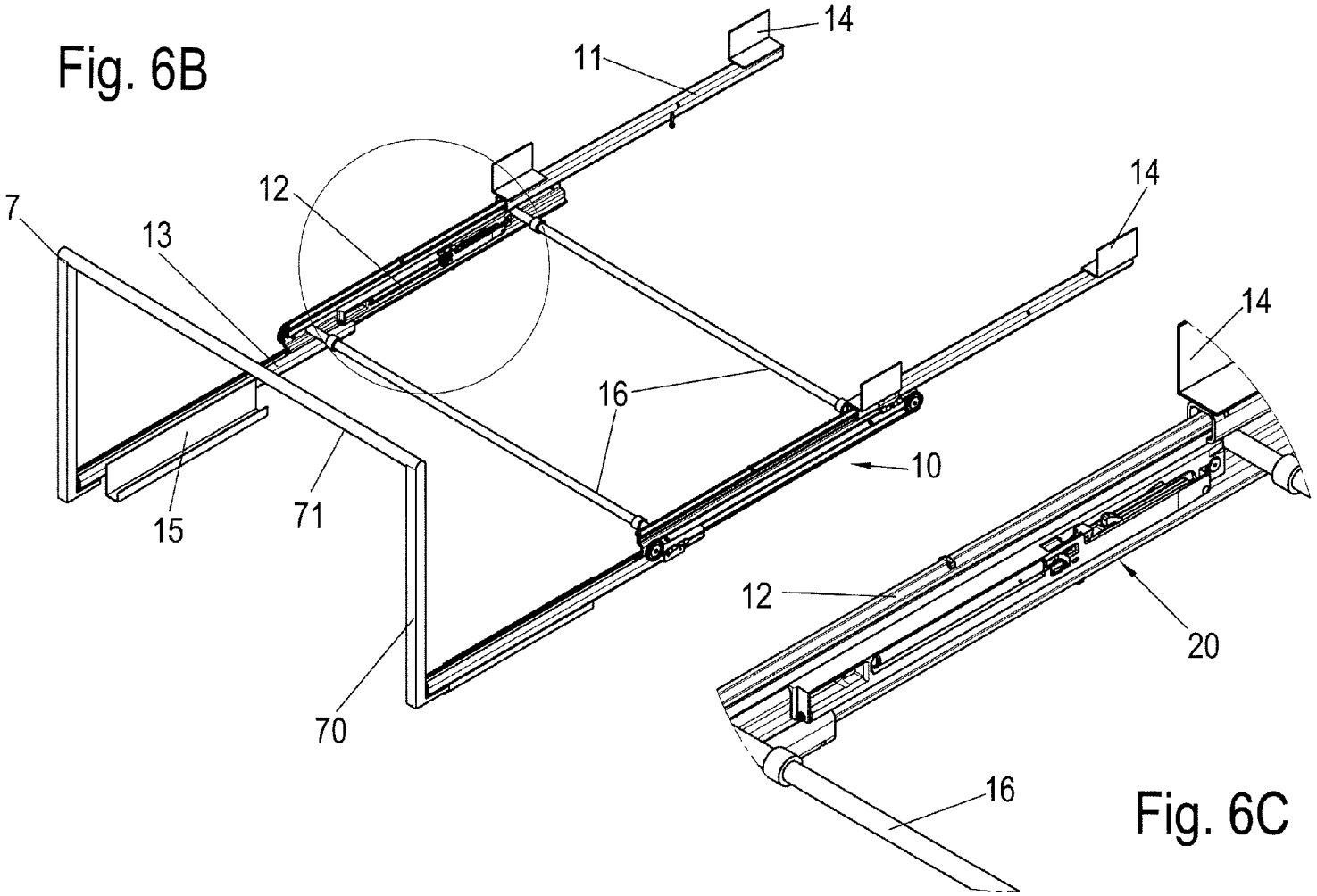

The pull-out guides 10 are arranged in a fully extended position in FIGS. 6A to 6C. The retainers 15 on the running rails 13 are situated with the first sliding element 5 far in front of the furniture body 2, as is also shown in FIG. 3. The middle rail 12 is also substantially situated before the furniture body 2, so that access to the upper sliding element 6 is ensured.

If the sliding assembly 4 is now to be moved back to the closed position, the user merely pushes the upwardly protruding actuating element 7 in the closing direction, so that the two pull-out guides 10 automatically travel in the closing direction. Prior to reaching the closed position, the self-retracting apparatus 20 optionally produces a deceleration via an integrated damper and a self-retracting mechanism up to the closed position, which is shown in FIG. 1.

Figure 7:
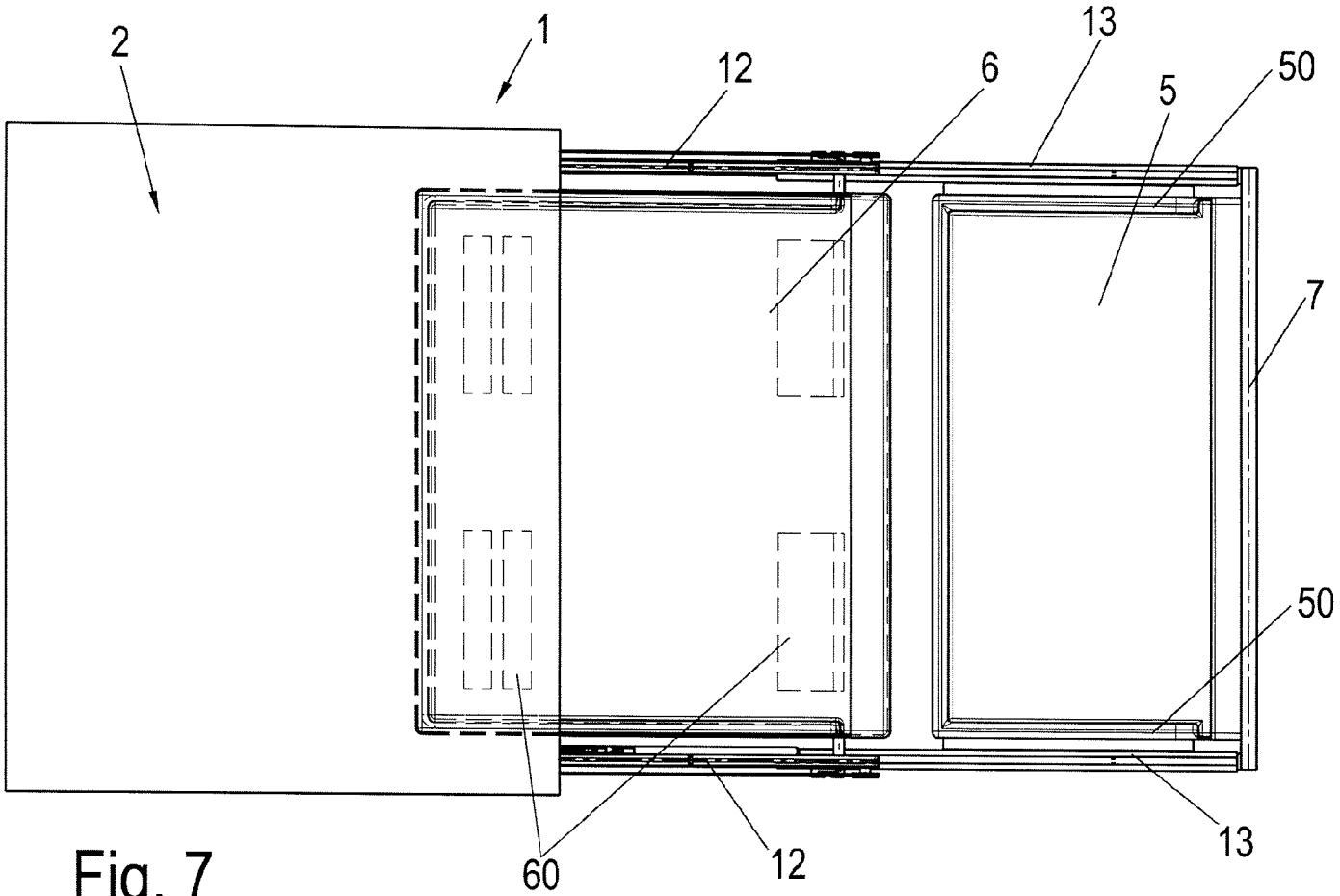
FIG. 7 shows a top view of the sliding assembly of FIG. 3 in a maximum extended position.

FIG. 7 shows the maximum extended position of the sliding assembly in a top view. The first bottom sliding element 5 is fully situated in front of the upper second sliding element 6, so that access from above is easily possible. The bottom first sliding element 5 is formed in a shorter way than the upper sliding element 6, preferably only half as long as the upper sliding element, so that the overall space in the furniture body 2 can be used for other purposes, e.g. for the use of a compressor in a refrigerator. The upper sliding element 6 is arranged more than 60%, especially more than 70%, in front of the furniture body 2, so that items can be removed with ease. The first sliding element 5 comprises a specially formed edge region 50 on both sides for the reversible fixing to the retainers 15, which edge region corresponds to the shape of the retainers 15. The second sliding element 6 is placed on the connecting rods 16 in such a way that the projections 60 on the bottom side, which are shown in the illustration with the broken lines, are each arranged on both sides of the connecting rods 16 and thus secure the sliding element 6 on the rods against lateral slippage and a tilting movement. In this respect, the distances of the projections 60 in relation to each other can decrease from the bottom side to their top side, so that smooth engagement of the projections 60 with the connecting rods 16 is enabled on the one hand and an interlocking connection between the projections 60 and the connecting rods 16 is present on the other hand in the inserted end position.

It is also possible that the retainers are formed for at least one of the sliding elements 5, 6 as a circumferential frame or a plate. The sliding elements 5, 6 can alternatively also comprise retaining elements themselves, as a result of which they can be fixed directly to the pull-out guides 10. It is also possible that the sliding elements 5, 6 are rigidly connected to the pull-out guides 10.

In the illustrated embodiment, the sliding assembly 4 is used in a refrigerating appliance. It is obviously also possible to use the sliding arrangement for other purposes, e.g. in furniture items or other domestic appliances such as dishwashers or warming drawers.

LIST OF REFERENCE NUMERALS

1 Domestic appliance
2 Furniture body
3 Side wall
4 Sliding assembly
5 Sliding element
6 Sliding element
7 Actuating element
10 Pull-out guide
11 Guide rail
12 Middle rail
13 Running rail
14 Mounting bracket
15 Retainer
16 Connecting rod
20 Self-retracting apparatus
21 Deflection pulley
22 Deflection pulley
23 Cable pull
24 Connecting element
25 Section
26 End
27 Section
28 End
30 Connecting element
50 Edge region
60 Projection
70 Leg
71 Connecting element

The invention claimed is:

1. A sliding assembly, comprising:

two pull-out guides which are fixable to opposite side walls and which each comprise a stationary guide rail, a middle rail movably mounted on the guide rail by rolling bodies or rollers, and a running rail movably mounted on the middle rail by rolling bodies or rollers, wherein a first sliding element is retained on the two running rails of the two pull-out guides, a second sliding element is retained on the two middle rails of the two pull-out guides, and the first and second sliding elements are drawers.

2. The sliding assembly according to claim 1, wherein movement of the running rails in relation to the middle rails is synchronized at least on one pull-out guide by a synchronizer.

3. The sliding assembly according to claim 2, wherein a cable pull is provided for synchronization on at least one pull-out guide.

4. The sliding assembly according to claim 1, further comprising:

retainers on the running rails and/or on the middle rails, wherein the first sliding element is fixable to the retainers on the running rails, and/or the second sliding element is fixable to the retainers on the middle rails.

5. The sliding assembly according to claim 4, wherein the first sliding element and/or the second sliding element comprise regions which interact with the retainers.

6. The sliding assembly according to claim 4, wherein the retainers are formed as mounting brackets, as connecting rods, as a circumferential frame or as a plate.

7. The sliding assembly according to claim 1, wherein the first sliding element is arranged beneath the second sliding element as a bottom one of the two sliding elements.

8. The sliding assembly according to claim 7, further comprising an actuating element that protrudes upwardly on the bottom first sliding element on the front side.

9. The sliding assembly according to claim 8, wherein the actuating element is fixed on opposite sides to the running rails.

10. The sliding assembly according to claim 8, wherein the actuating element protrudes at least partly beyond a front side of the second sliding element which forms an upper second sliding element.

11. The sliding assembly according to claim 1, wherein the first sliding element arranged below the second sliding element is formed shorter than the second sliding element in a longitudinal direction of the pull-out guides.

12. The sliding assembly according to claim 11, wherein the first sliding element is shorter than the second sliding element by at least 20%.

13. The sliding assembly according to claim 1, wherein the running rail is respectively arranged beneath the guide rail.

14. A domestic appliance, comprising a sliding arrangement according to claim 1.

15. The domestic appliance according to claim 14, wherein the domestic appliance is a refrigerating appliance.

16. A piece of furniture with a sliding arrangement according to claim 1.

* * * * *